United States Patent [19]

Hounsel

[11] Patent Number: 4,473,015

[45] Date of Patent: Sep. 25, 1984

[54] SELF-SUPPORTING FABRIC REINFORCED REFRACTORY FIBER COMPOSITE CURTAIN

[75] Inventor: Mack A. Hounsel, Houston, Tex.

[73] Assignee: J. T. Thorpe Company, Houston, Tex.

[21] Appl. No.: 316,724

[22] Filed: Oct. 30, 1981

[51] Int. Cl.[3] ..... F23M 5/00; F23M 5/06; F04B 5/52; F04B 1/38

[52] U.S. Cl. ..... 110/336; 110/331; 52/474; 52/486; 52/506

[58] Field of Search ..... 52/506, 474, 64, 404, 52/486; 432/115, 167, 169, 242; 98/50; 110/331, 336, 233; 89/36 A; 102/303

[56] References Cited

U.S. PATENT DOCUMENTS

| | | | |
|---|---|---|---|
| 2,893,068 | 7/1959 | Johnson et al. | 52/474 |
| 4,222,337 | 9/1980 | Christiansen | 110/336 |
| 4,233,468 | 11/1980 | Northup, Jr. | 52/506 |
| 4,287,839 | 9/1981 | Severin et al. | 110/331 |
| 4,318,259 | 3/1982 | Verheyden | 52/506 |
| 4,339,902 | 7/1982 | Cimochowski et al. | 52/404 |

OTHER PUBLICATIONS

M. H. Detrick Company, "Heat Enclosure Methods", Chicago, Illinois, 1952, pp. 29, 33 and 37.

Trinks and Machinery, "Industrial Furnaces", vol. I, John Wiley & Sons, 1961, pp. 89–91; vol. II, 1967, pp. 276–277, 290 and 294–295.

Design News, "Composite Curtains Save Energy", Aug. 8, 1977; p. 28.

3M Company Product Bulletin, "Furnace Curtains", date unknown, prior to Applicant.

HITCO Non-Asbestos Textiles Product Data Bulletin, date unknown prior to Applicant.

ZETEX Typical Applications Brochure, date unknown, prior to Applicant.

Babcox & Wilcox Report, "Contract 3084 Final Report–Demonstration of Furnace Curtains to Reduce Heat Energy–Sites A and B", Mar. 4, 1980.

*Primary Examiner*—John E. Murtagh

*Assistant Examiner*—Andrew Joseph Rudy

*Attorney, Agent, or Firm*—Pravel, Gambrell, Hewitt, Kirk & Kimball

[57] ABSTRACT

Refractory fiber blankets are made suitable for use as baffles, curtains or partitions in furnaces and other high temperature equipment by reinforcement fabric woven from high temperature refractory fiber yarn. The curtains so formed are easily installed and replaced. The curtains exhibit insulation characteristics suitable for use at elevated (2200° F. and above) temperatures and capabilities of resisting damage from impact by the furnace load or manipulators of such a load.

17 Claims, 10 Drawing Figures

10
12
P
P
44
P
3
14
W
P
2
P
32
42
26
42
42
36
38
43
42
44
42
44
3
44
2

14
28
32
30
26

22
42
40
24
20
42
40
46
43
44

14
28
32
30
26
20a
22
24
42
40
20

43
34
42
40
44

SELF-SUPPORTING FABRIC REINFORCED REFRACTORY FIBER COMPOSITE CURTAIN

BACKGROUND OF INVENTION

1. Field of Invention

The present invention relates to partitioning between zones in ovens, furnaces and high temperature equipment.

2. Description of the Prior Art

In furnaces or other types of high temperature equipment, it has often been the practice to partition off various zones depending on heat and usage requirements. So far as is known, curtain wall members, baffles or partitions employed in the past have been in the form of rigid refractory fiber boards and blankets supported by a rigid frame often employing water tubes for cooling purposes.

Several problems were presented by this approach. In the event that the furnace load or its manipulators stuck or came into contact with one of these rigid partitions or wall members, the refractory boards were damaged and the entire wall structure typically rendered useless. Also, water in tubes in the frame posed the danger of potentially harmful water leaks. Further, even if the water tubes were never damaged or leaking, heat was absorbed in them, causing heat loss from the zone being heated, adversely affecting the uniformity of heat distribution in the heated zone.

Attempts were made to use refractory fiber blankets, formed into suspended unitary walls by overlapping and attaching adjacent blanket segments and suspending them about a heated zone. However, the material of the blankets did not exhibit sufficient tensile strength, even when sewn together with refractory yarns or threads, for self-support in suspension for periods of use longer than several weeks. Further, the fibers in the blanket became brittle and failed due to high temperatures. Again, if the unitary wall were struck by a furnace load, such as a billet, the wall was in effect then useless and an entire replacement wall was needed.

Refractory cloths or tape strips woven from continuous filament, amorphous silica products have recently been developed. Research has been done into their use as inlet and outlet curtains in openings for movement of workpieces in and out of industrial furnaces. The purpose of these curtains was intended to reduce radiation and convection heat losses from the furnace interior and cause some reradiation of heat back into the furnace, while still allowing movement of workpieces in and out of the furnaces. So far as is known, however, these fabric curtains have not been felt suitable for use in furnace interiors for insulative walls or baffles, because of their permeability to heat due to their relatively thin construction caused by the size of the fibers used in making the woven cloths or strips. Further, when exposed to high service temperatures, these fabrics tended to become brittle and easily damaged. Gas velocities within the furnace enclosure tended to blow the thin fabrics about, reducing their effectiveness.

SUMMARY OF INVENTION

Briefly, the present invention provides a new and improved curtain panel which forms a portion of a wall which partitions or divides internal zones of a furnace or other high temperature equipment or directs the flow of hot gases. The panel includes a refractory fiber blanket which insulates adjacent zones of the furnace from each other. The panel is attached by suitable attaching structure to a roof or other surface of the high temperature equipment. The blanket is formed from plural downwardly hanging sheet members which are suspended from the attaching structure. The sheets of the blanket are attached to a reinforcing fabric which is mounted between the sheets and supports them so that the relatively pliable fiber blanket functions as a panel. The reinforcing fabric is also suspended from the attaching structure and is preferably formed from a high temperature refractory fiber yarn, such as a continuous filament amorphous silica product. A number of panels are typically mounted aligned in a row to form a wall according to the present invention.

With the present invention, it has been found that the refractory fiber cloth which serves as the reinforcing fabric is sufficiently protected from high temperature and harmful atmospheric conditions in the furnace so that relatively little embrittlement of the reinforcing fabric occurs. However, the reinforcing fabric coacts with the relatively pliable fiber blanket and supports the blanket to form a sufficiently strong structural member to function as partitioning panels or dividers within internal zones of high temperature equipment.

DESCRIPTION OF PREFERRED EMBODIMENT

Figure 1:
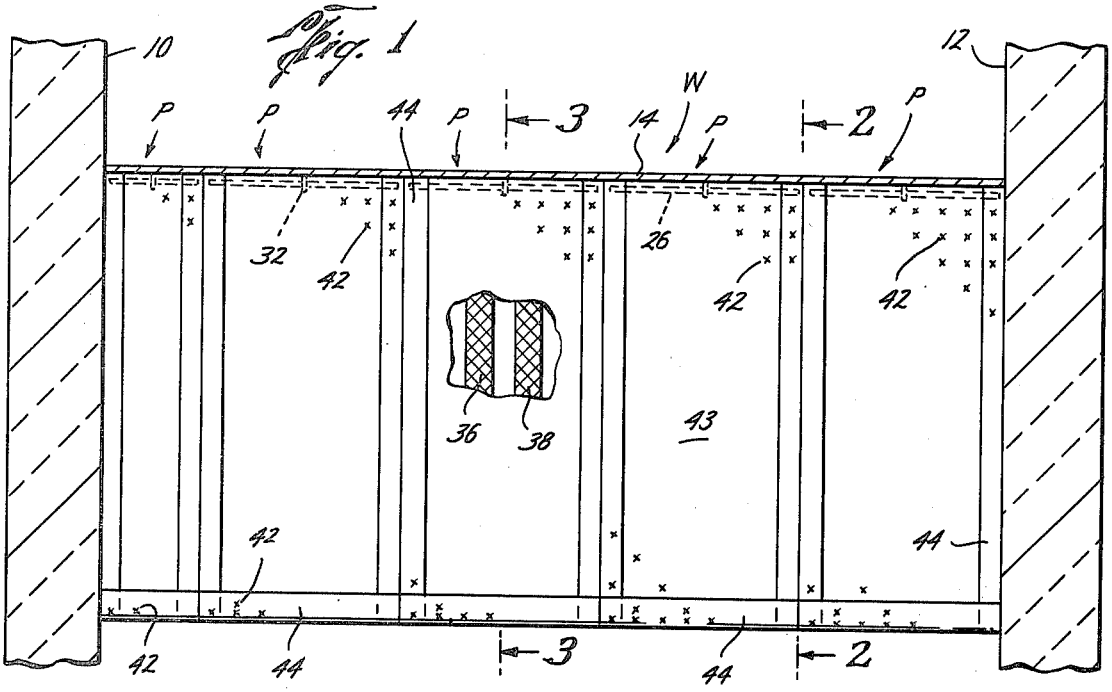
FIG. 1 is an elevation view of a composite curtain according to the present invention.

In the drawings, the letter W designates generally a partition or dividing wall in accordance with the present invention for separating adjacent zones of a furnace or other high temperature equipment, such as rotary furnaces, steel mill slab furnaces, heat treating units or the like. The wall W is formed from a plurality of adjacent curtain panels P mounted aligned in a row and shown in one embodiment extending between walls of refractory brick 10 and 12 beneath a roof or other surface 14 to function as a temperature dividing zone to maintain different temperatures in two adjacent zones. It should be understood that the embodiment shown in FIG. 1 is given only by way of example and that the wall W of the present invention may be used for other purposes, for example as a baffle to control movement of hot gases within high temperature equipment. The panels P may be of any suitable width and different blanket members may have different widths (FIG. 1), depending upon installation requirements.

Figure 2:
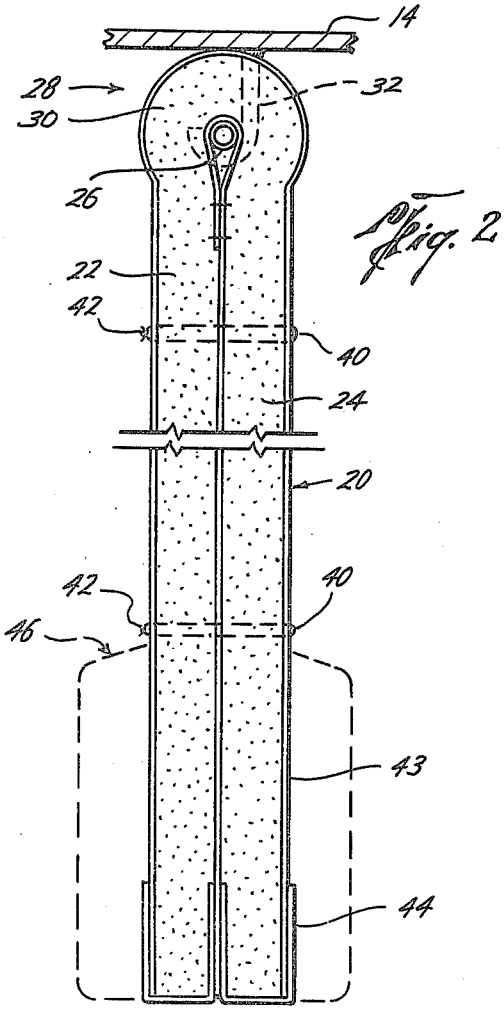
FIG. 2 is a cross-sectional view taken along the lines 2—2 of FIG. 1.
Figure 3:
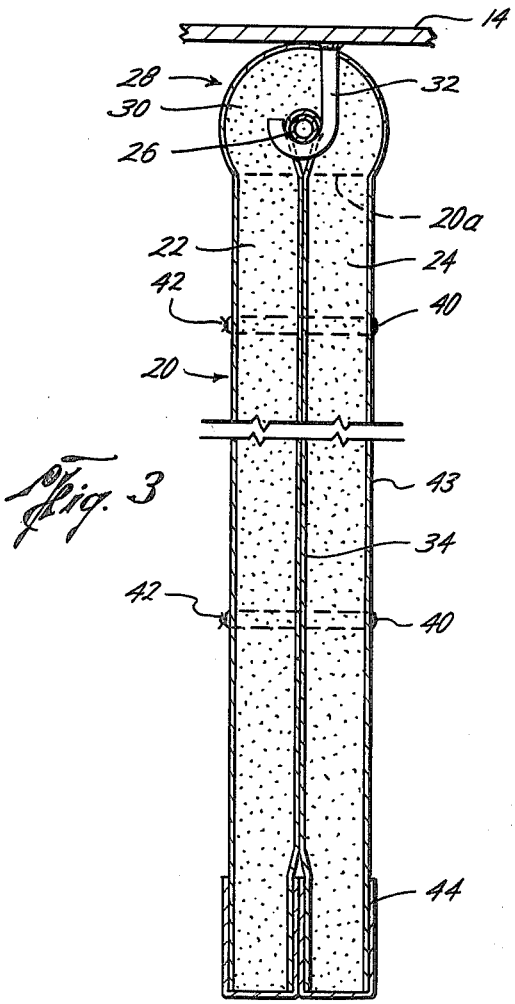
FIG. 3 is a cross-sectional view taken along the lines 3—3 of FIG. 1.

Each of the panels P includes a composite refractory fiber blanket member 20 (FIGS. 2 and 3) in the form of an inverted-U of downwardly extending or hanging sheet members 22 and 24 suspended from a suspension rod 26 of an attachment member 28.

The fiber blanket member 20 is preferably formed of a commercially available high temperature refractory fiber blanket material, such as those sold under the trademarks Durablanket, Cerablanket, Kaowool or the like. The particular material selected for use in the fiber blankets 20 depends, of course, on factors such as expected temperature conditions and the like. The blanket member 20 further includes a top center portion 30 interconnecting the sheets 22 and 24 and passing between the support rod 26 and the surface 14. The center portion 30 need not be included in some situations, and a blanket 20 formed of two separate sheets ending at a phantom line 20*a* may be used, if desired. The support rod 26 is suspended by a hook or other suitable hanging member 32 which is attached by welding or the like to the surface 14 and which is adapted to receive the suspending rod 26 therein. The suspending rod 26 may be either solid or hollow, as desired. The suspending rod 26 may be an air or liquid cooled pipe spaced from the primary refractory within a heating enclosure and spanning the heat enclosure.

A reinforcing fabric sheet 34 is mounted between and attached to the blanket sheets 22 and 24. The reinforcing fabric 34 is formed of a fabric woven from continuous filament, amorphous silicia products having suitable thermal performance characteristics, such as those sold under the trademarks Nextel 312 or Refrasil, depending upon particular temperature requirements chosen. Further, fiberglass cloth or woven wire mesh may be used as the reinforcing fabric 34 if the temperatures are low enough.

The fabric 34 is suspended from the rod 26 to support the remaining structure of the panel P in place beneath the surface 14. The fabric 34 may be in the form of an inverted U composed of two sheets (FIG. 3) hanging from rod 26 or in the form of a single sheet suspended from an upper hem or loop of the fabric (FIG. 2) which encloses the rod 26.

The reinforcing fabric 34 may be formed from a single sheet coextensive in surface area with the sheets 22 and 24, or from a number of strip sheets, such as those shown with reference numerals 36 and 38 (FIG. 1), of suitable width mounted at spaced positions from each other across the lateral space between the sheets 22 and 24. The reinforcing fabric 34 is mounted between the sheets 22 and 24 by anchoring fibers or threads 40 which are inserted twice through each of sheets 22 and 24 and reinforcing fabric 34 and have end members tied, as indicated at 42, together. Preferably, a number of anchoring threads 40 are mounted at spaced positions from each other across the width and height of the surface area of the panel P in a quilt-like fashion (FIG. 1). To preserve clarity in the drawings, all of such anchoring threads are not shown in the drawings. The fabric 34 and sheets 22 and 24 could also be machine sewn together or attached by ceramic pins.

The outer surface of the panel P is enclosed within an exterior fabric cover or container sheet 43 of similar material to the fabric 34. Cover sheet 43 contains the blanket 20, provides a member to which the anchoring threads 40 are attached and provides abrasion resistance and manipulability to the panel.

Additionally, a border reinforcement member 44 woven from a similar material to the reinforcing fabric 34 may be formed about bottom and side peripheral edges or sides of the sheet members of panels P for ease of handling and manipulability during installation of the panel P. The border members 44 are attached to the blanket 20 by anchoring cords which are of like structure to the anchoring cords 42 and accordingly bear like reference numerals.

If desired, for additional weight or stiffness or other reasons, a lower pad member 46 (shown in phantom in FIG. 2) may be formed at the ends of either or both of the sheets 22 and 24. If this is done, the border members 44 are mounted to extend and enclose the pad member 46.

As has been previously been set forth, it has generally been the experience in the industry that the continuous filament amorphous silica cloth when exposed to high temperature conditions tend to devitrify and become brittle. Further, the relative pliability and lack of strength in suspension of the refractory fiber blankets has caused it to be thought that such blanket members would not have sufficient strength to function to partition zones in high temperature equipment.

However, with the present invention, the reinforcing fabric 34 is mounted between and sheltered from the relatively high temperatures and possibly harmful atmospheric conditions within the high temperature equipment by means of the refractory ceramic fiber blanket sheets 22 and 24 and the cover sheet 43. With this structural arrangement, it has been found that the reinforcing fabric 34 is maintained in a suitably pliable condition, even at temperatures on the order of 2300° F., to give strength and support to the blanket 20. Additionally, the reinforcing fabric 34 provides necessary strength and support for the blanket member 20 of the panel P, particularly in suspension from the upper surface 14 of the furnace.

It is also to be noted that each of the individual panels P in the wall W are individually relatively movable with respect to adjacent panels. Thus, in the event that one of the panels P is contacted by a billet or a manipulator thereof during use, such panel P will move and yield independently rather than breaking or pulling an entire wall W down. In the event that one of the panels P of the present invention is, however, damaged when contacted, this individual damaged panel P may be removed and replaced, without necessitating an entire wall to be removed and replaced.

Figure 4:
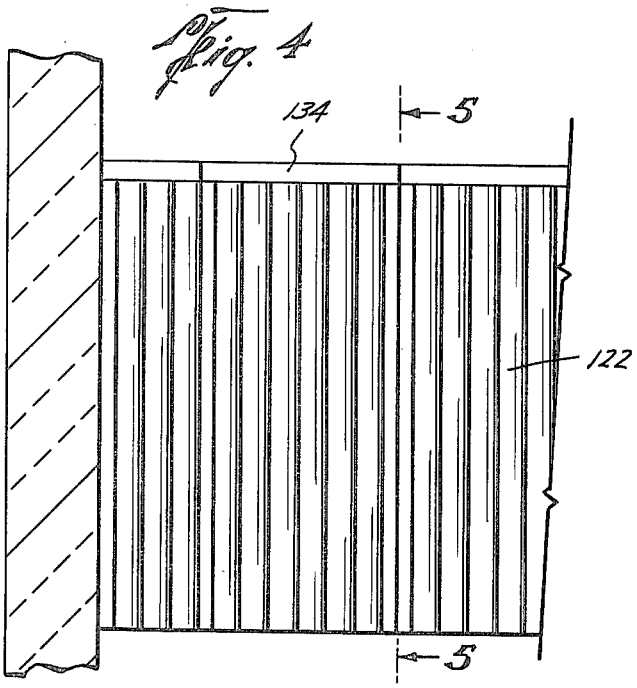
FIG. 4 is an elevation view of another composite curtain according to the present invention.
Figure 5:
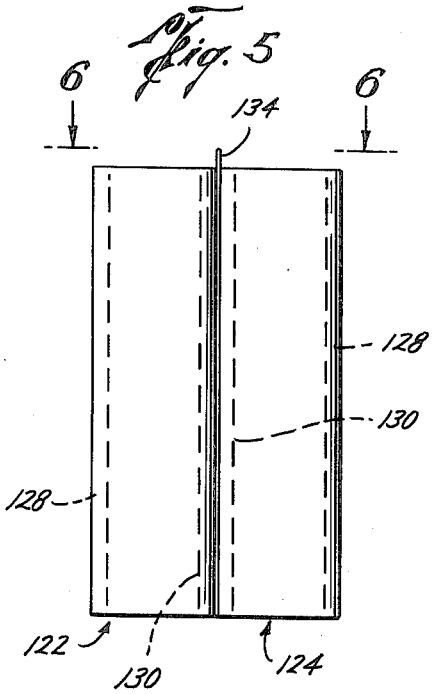
FIG. 5 is a cross-sectional view taken along the lines 5—5 of FIG. 4.
Figure 6:
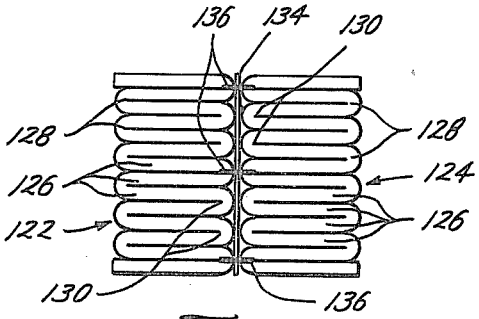
FIG. 6 is a cross-sectional view taken along the lines 6—6 of FIG. 5.

The panels P of the present invention may take other forms, as well, if desired. For example exterior walls can be built up by adding more layers of blanket. In a panel P-1 (FIGS. 4–6), functioning as a front wall of a slot furnace, sheets 122 and 124 are mounted with a reinforcing fabric 134 which is attached by bolts or other suitable structure to a roof structure of the slot furnace. The reinforcing fabric 134 supports the weight of the sheets 122 and 124 as well as its own weight. Each of the sheets 122 and 124 are folded into a plurality of adjacent layers 126 of refractory fiber material of the type set forth above. Depending upon the temperature and conditions to be encountered in the furnace, sheets 122 and 124 may be formed of materials having different temperature ratings because of the thermal gradient across the panel P-1. The layers 126 of the sheets 122 and 124 extend between outer folds 128 and inner folds 130 formed between the adjacent layers 126 alternately at outer and inner ends. The sheets 122 and 124 are attached to the reinforcing fabric 134 by being sewn thereto by a suitable thread 136, such as of the type from which the fabric 134 is woven. The threads 136 are inserted by needles and extend from the inner folds 130 through the sheets 122 and 124 and the reinforcing fabric 134 to the adjacent inner fold 130 to form the panel P-1 of the present invention.

Figure 7:
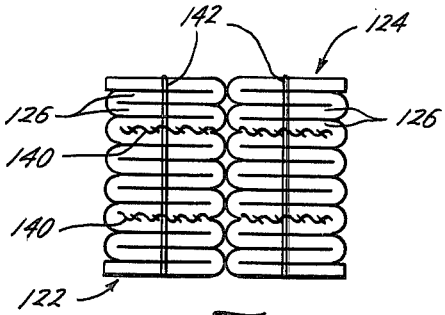
FIG. 7 is a cross-sectional view of alternative structure to that of FIG. 6.

Alternatively (FIG. 7), the sheets 122 and 124 may have reinforcing fabric sheet members 140 mounted in selected location between adjacent layers 126. In this situation, the sheets 122 and 124 and the reinforcing fabric sheet members 140 are connected together into wall modules by suitable anchoring threads 142 extending through the adjacent layers 126 of the sheets 122 and 124.

Figure 8:
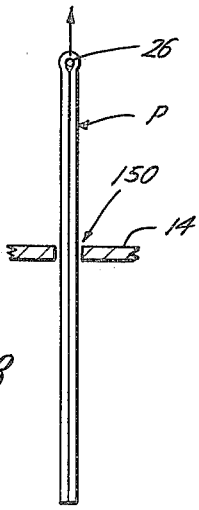
FIGS. 8, 9 and 10 are schematic diagrams of structure by means of which composite curtains of the present invention are relatively movable into and out of position for service as partition walls or dividers.
Figure 9:
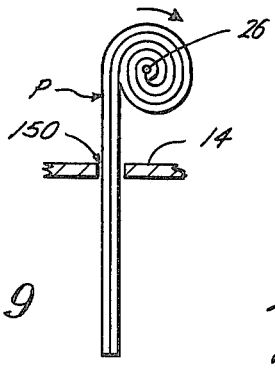
Figure 10:
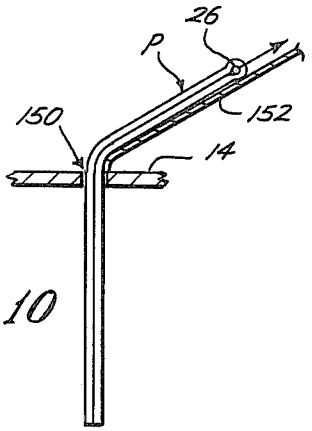

In situations where it is desired to mount the panels of the present invention for relative movement into and out of position dividing zones of the high temperature equipment, the support rods 26 for such panels may be mounted with hoisting structure for relative vertical movement (FIGS. 8, 9 and 10) with respect to a slot 150 formed in the roof 14. The panels are moved into and out of position by having their support rod 26 lifted vertically (FIG. 8) by suitable hoisting structure, rotated (FIG. 9) by a motor or drawn upwardly over an inclined support surface 152 (FIG. 10) by a hoist or otherwise as conditions require.

The foregoing disclosure and description of the invention are illustrative and explanatory thereof and various changes in the size, shape and materials as well as in the details of the preferred embodiment may be made without departing from the spirit of the invention.

I claim:

1. A curtain panel forming a portion of a wall partitioning adjacent internal zones of a furnace or other high temperature equipment, comprising:

(a) a refractory ceramic fiber blanket insulating adjacent internal zones of the high temperature equipment from each other;

(b) said fiber blanket comprising plural sheet members hanging downwardly into the high temperature equipment between the internal zones to be partitioned;

(c) reinforcing fabric means mounted between and attached to said sheet members of said blanket for supporting portions of said blanket so that said blanket functions as a panel; and (d) means for attaching said reinforcing fabric means to a roof or other surface of the high temperature equipment.

2. The structure of claim 1, wherein said reinforcing fabric means comprises:

a reinforcement fabric woven from a high temperature refractory fiber yarn.

3. The structure of claim 1, wherein said reinforcing fabric means comprises:

a fabric panel substantially co-extensive in surface area with said sheet members of said blanket.

4. The structure of claim 1, wherein said reinforcing fabric means comprises:

a plurality of fabric panel strip members mounted at spaced positions from each other between and attached to said sheet members of said blanket.

5. The structure of claim 1, further including:

border reinforcement member means mounted along at least one perpheral edges of said sheet members of said blanket.

6. The structure of claim 5, wherein said border reinforcement member means comprises:

a reinforcement fabric woven from a high temperature refractory fiber yarn.

7. The structure of claim 1, further including:

anchoring fiber means extending through said sheets of said blanket and said reinforcing fabric means for attaching same.

8. The structure of claim 1, further including:

insulating fiber blanket pad means mounted at lower ends of said sheets of said blanket.

9. The structure of claim 1, wherein said sheets of said blanket are folded to a plurality of adjacent layers of fiber insulating material with folds formed between said adjacent layers alternately at outer and inner ends thereof.

10. The structure of claim 9, wherein:

said reinforcing fabric means is mounted between and attached to said inner ends of said sheets of said blanket.

11. The structure of claim 9, wherein:

said reinforcing fabric means is mounted between and attached to folds formed between said adjacent layers of said sheets of said blanket.

12. The structure of claim 1, wherein:

said fiber blanket further comprises a center strip connecting said sheets.

13. The structure of claim 1, wherein said means for attaching comprises:

(a) support rod means mounted within said blanket; and (b) means for mounting said support rod means with the surface of the high temperature equipment.

14. The structure of claim 1, wherein said means for attaching includes:

means for moving said blanket and said reinforcing fabric means into and out of place to partition the internal zones of the high temperature equipment.

15. The structure of claim 1, further including:

an outer cover sheet enclosing said sheet members of said blanket and said reinforcing fabric.

16. A curtain wall partitioning internal zones of a furnace or other high temperature equipment, said curtain wall being formed of a plurality of adjacent curtain panels, each of said panels comprising:

(a) a refractory ceramic fiber blanket insulating adjacent internal zones of the furnace from each other;

(b) means for attaching said blanket to a roof or other surface of the high temperature equipment;

(c) said fiber blanket comprising plural sheet members suspended from said means for attaching and handing downwardly into the high temperature equipment between internal zones to be partitioned; and (d) reinforcing fabric means mounted between and attached to said sheet members of said blanket for supporting portions of said blanket so that said blanket functions as a panel.

17. The structure of claim 16, wherein said panels are mounted for relative movement with respect to each other when contacted by an object in one of the internal zones.

* * * * *